United States Patent [19]

Smyrl

[11] 3,952,804

[45] Apr. 27, 1976

[54] SAND CONTROL FOR TREATING WELLS WITH ULTRA HIGH-PRESSURE ZONES

[75] Inventor: Kenneth E. Smyrl, Marrero, La.

[73] Assignee: Dresser Industries, Inc., Dallas, Tex.

[22] Filed: Jan. 2, 1975

[21] Appl. No.: 537,878

[52] U.S. Cl. ..... 166/278; 166/313; 166/51

[51] Int. Cl.[2] ..... E21B 43/04

[58] Field of Search ..... 166/278, 51, 276, 142, 166/147, 313, 191

[56] References Cited

UNITED STATES PATENTS

| | | | |
|---|---|---|---|
| 1,487,097 | 3/1924 | Gallagher | 166/191 X |
| 1,641,035 | 8/1927 | Hero | 166/191 X |
| 2,224,538 | 12/1940 | Eckel et al. | 166/278 |
| 3,627,046 | 12/1971 | Miller et al. | 166/278 |
| 3,710,862 | 1/1973 | Young et al. | 166/278 |
| 3,726,343 | 4/1973 | Davis, Jr. | 166/278 |
| 3,800,875 | 4/1974 | Hardy et al. | 166/278 |
| 3,850,246 | 11/1974 | Despujols | 166/278 |
| 3,913,676 | 10/1975 | Barbee, Jr. et al. | 166/278 |

*Primary Examiner*—Stephen J. Novosad
*Assistant Examiner*—George A. Suckfield
*Attorney, Agent, or Firm*—Michael J. Caddell

[57] ABSTRACT

Apparatus and method of placing aggregate packs in a well bore annulus wherein one or more producing high-pressure formations are penetrated includes the use of multiple packer and sandscreen assemblies placed in the borehole one at a time with a dual conduit aggregate placement tool string used to place the aggregate pack at each interval.

11 Claims, 4 Drawing Figures

SAND CONTROL FOR TREATING WELLS WITH ULTRA HIGH-PRESSURE ZONES

BACKGROUND OF THE INVENTION

In underground formations penetrated by drilled boreholes wherein the formations contain loose sands and soft sandstone strata, a constant problem in well flow through the borehole involves the migration of the loose sands and degraded sandstone into the well bore due to destruction of the formation caused by the pressure and flow of the fluids therethrough.

While numerous techniques have been used to prevent this migration of fine particles which clog the production system and seriously erode the tools in the string, two basic techniques have evolved. The first is basically a chemical treatment involving injection of a fluid into the formation and reacting the fluid chemically or with heat to set up a permeable gel or solid to retain the sand while allowing fluid flow therethrough. This method suffers from a lack of homogeneity caused by voids in the gel due to incomplete saturation of the initial fluid and the setting fluid.

The second technique involves a physical technique of placing a graded aggregate in the borehole to form a porous screen between the production string and the formation wall. This technique is commonly referred to as gravel packing and generally involves the placement of finely graded aggregate such as ottawa sand, walnut shells, glass beads, etc., through a crossover tool or by a washing-in tool.

These tools suffer from the disadvantages of complexity, contamination of pumps, and moving parts with the aggregate, and a lengthy multi-step process of gravel placement. For instance, when the liner is washed into place, at least two runs of the tool string into the well bore are required for each aggregate pack.

Also the prior devices result in a great infusion of circulating fluid into the formation to place the aggregate. This is undesirable in that it interferes with the normal flow of formation fluids to the well bore. Furthermore, the prior devices do not offer the degree of control which is desirable when zones of high-pressure are being treated.

DESCRIPTION OF THE PREFERRED EMBODIMENTS

Figure 1:
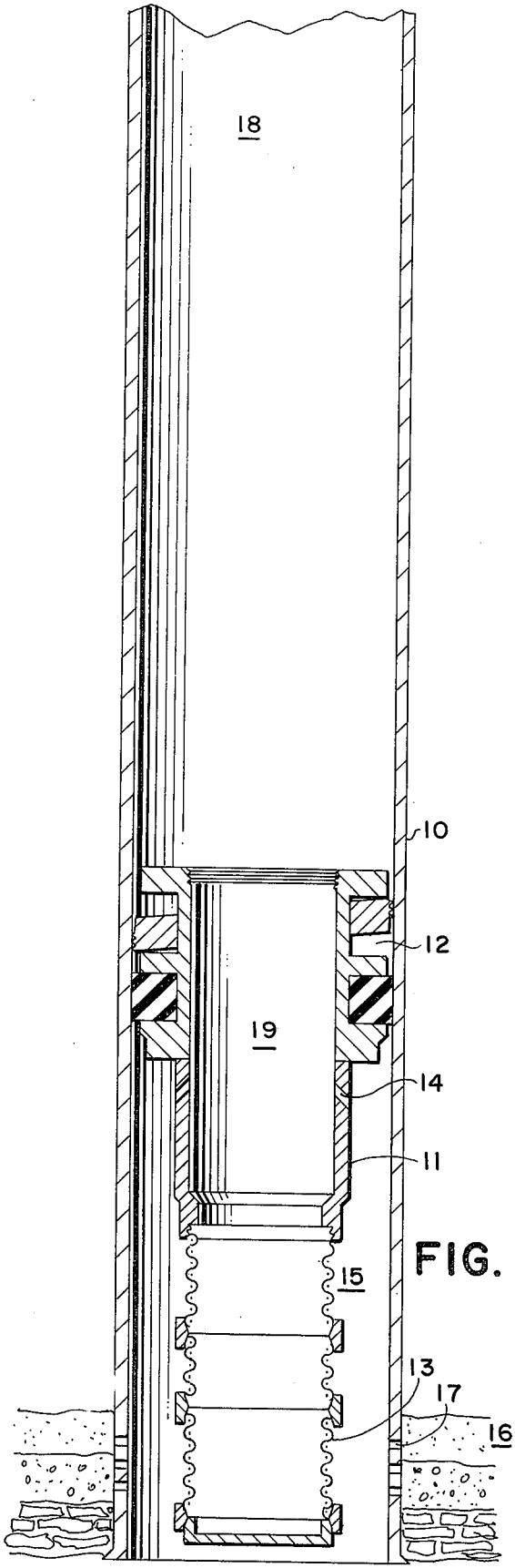
FIG. 1 illustrates in schematic cross-section a well bore and the first stage of the apparatus.

Referring now to FIG. 1, the cased borehole 10 penetrates the high-pressure underground formation 16 and communicates therewith by means of multiple perforations 17. A packer mandrel 11 containing packer 12 and one or more sandscreens 13 is lowered into the casing 10 until the sandscreens 13 are located in the vicinity of formation 16 to be produced. The packer 12 is then set by hydraulic actuation, wireline set, or mechanical set as is known in the art.

Setting of packer 12 isolates an annular area 15 around mandrel 11 and screens 13 from the remainder of the bore area 18. A plurality of ports 14 are provided through the wall of mandrel 11 to provide communication from bore passage 19 of mandrel 11 to the annular area 15. It should be noted that whereas a cased borehole 10 is indicated, the apparatus and the methods of this invention are applicable also to open boreholes.

Figure 2:
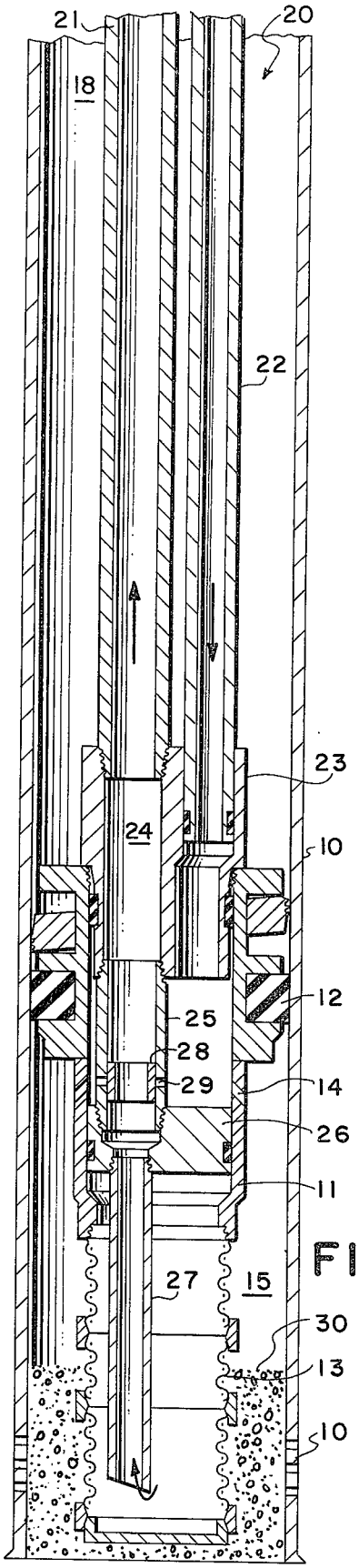
FIG. 2 illustrates the second apparatus stage.

Referring now to FIG. 2, a dual conduit tubing string 20 is lowered into the borehole 18 and through packer 12 to sealingly engage mandrel 11. Dual string 20 includes a primary string 21 and a secondary string 22, both of which are engaged in a dual bore collar 23. Collar 23 is arranged to sealingly engage the internal bore of packer 12 and contains at the lower end of the primary bore 24 an extension tube 25. Tube 25 extends through packer 12 and engages an eccentric bore seal disc 26 having a restricted bore therethrough. A fluid return tailpipe 27 is engaged in the bore of seal disc 26 coaxially aligned with tube 25, bore 24 of collar 23, and primary tube 21. Seal disc 26 is arranged to sealingly engage in the bore of mandrel 11 below multiple ports 14.

A sliding sleeve valve 28 is located within extension tube 25 and arranged to provide porting valve arrangement with respect to multiple ports 29 through the wall of tube 25. An aggregate pack 30 is placed in the annulus 15 between casing 10 and screens 13. The pack is placed in the annulus by suspending the aggregate in a carrier fluid, pumping the fluid down secondary tube 22 through packer 12, out ports 14, and into the annulus 15. The screen 13 prevents the pack from moving back up the bore of mandrel 11. The fluid passes through screens 13, up through the bottom of washpipe 27, through extension tube 25, bore 24, and to the surface by means of primary tube 21.

It should be noted that in addition to the placement of the aggregate pack in the well, other operations can be performed such as acidizing and/or fracturing of the formation. After the aggregate pack has been placed in the annulus, valve 28 is opened and the well is killed by pumping heavy fluid down the secondary tube 22, through ports 29, and up the primary tube 21. This prevents a hazardous blow-out from high pressure gas, oil, and/or water in formation 16.

After the well is killed, the dual conduit string 20 is pulled from the well leaving the packer, the ported mandrel, and the sandscreen assembly in the well. It should be noted that the actuation of sleeve valve 28 is accomplished by means known in the art such as dropping a valve member down tubing string 21 to seat in valve sleeve 28 and then applying pressure to the fluid in conduit 21 to move the sleeve 28 down to expose ports 29.

Figure 3:
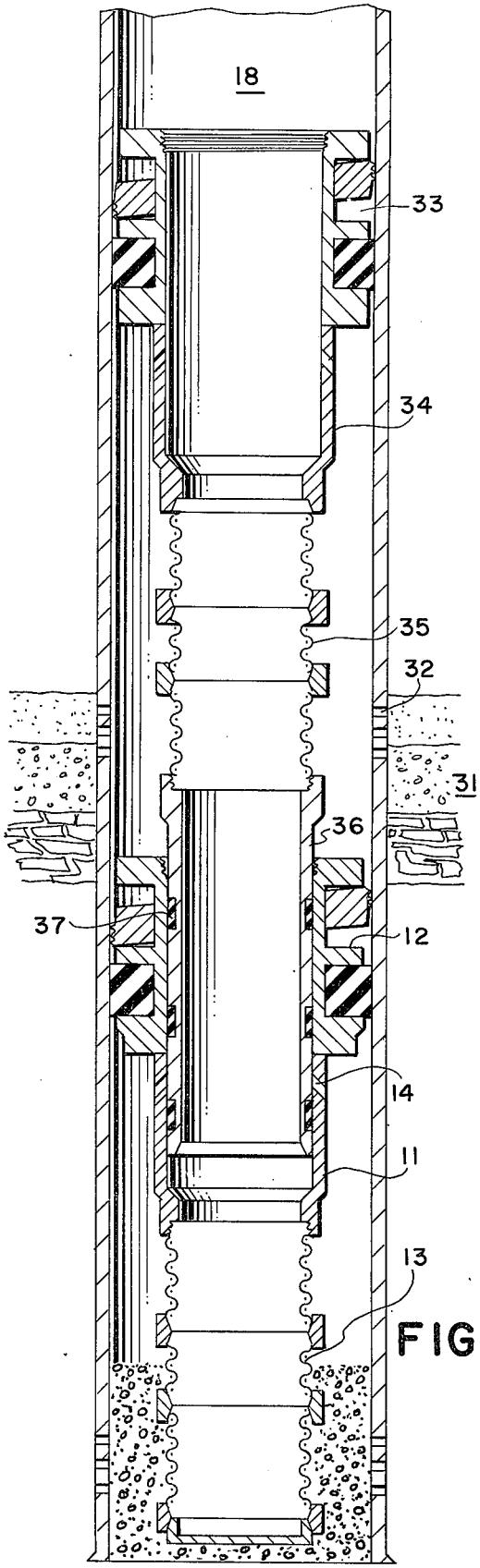
FIG. 3 illustrates the third stage of operation.
Figure 4:
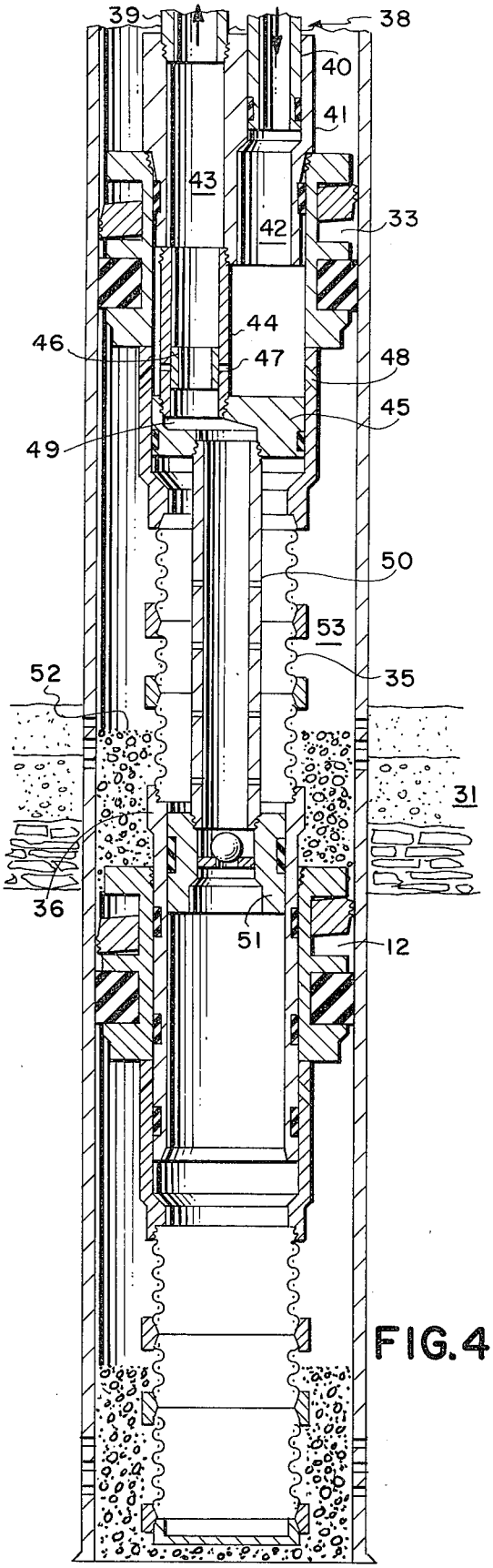
FIG. 4 illustrates the final stage of operation.

Referring now to FIG. 3, a second producing interval 31 is placed in communication with well bore 18 by means of multiple perforations 32. A second packer assembly comprising packer 33, packer mandrel 34, sandscreen 35, and lower seal extension 36 is lowered into the well bore and into packer 12, sealingly engaging therein. Extension 36 is provided with multiple seals 37 which seal inside the inner bore of packer 12 and mandrel 11. The seals on extension 36 are arranged to seat above and below ports 14 thereby closing off and isolating this set of ports.

After the second packer assembly has been placed in the well and seated in the first packer assembly, a second dual conduit tubing string 38 is lowered into the well to pass into sealing engagement in packer assembly 33 and extension 36. Dual string 38 comprises primary string 39 and secondary string 40, both of which are engaged in a dual bore collar 41. Collar 41 is sealingly engaged in the bore of packer 33 and has a seconary bore opening 42 and a primary bore opening 43. Lower extension tube 44 is engaged in collar 41 coaxially with bore 43 and extends through packer 33 into an eccentrically bored seal disc 45.

Extension tube 44 also has a sliding sleeve valve 46 therein arranged to alternately cover and expose a set of ports 47 which are arranged to align with ports 48 in mandrel 34. Disc 45 has an offset bore 49 passing therethrough, communicating with a perforated fluid return conduit 50 which extends downward into sleeve 36. At the lower end of conduit 50 is a ball and seat checkvalve 51.

The length and location of sandscreen 35 and perforated conduit 50 are both arranged to place them in very close proximity to the second producing formation 31. The aggregate pack 52 is placed in the bore annulus above packer 12 by pumping a carrier fluid containing the aggregate down the secondary conduit 40, through ports 48, and into the upper annulus area 53. The aggregate is prevented from passing inward by screens 35 but fluid is allowed to pass therethrough through perforated conduit 50, up through bore 49, sleeve 46, bore 43, and out primary conduit 39.

After the desired quantity of aggregate has been packed in the annulus 53, the well may be killed similarly to the operation of FIG. 2 by actuating sleeve valve 46 to expose ports 47 and pumping the killing fluid down the secondary tube 40, into ports 47, and up through the primary tube 39. Checkvalve 51 has been provided to allow production fluid from formation 16 to flow upward while preventing fluid flow downward through packer 12 at all times during treatment of formation 31. As was contemplated with respect to formation 16, other treatment operations such as fracturing and acidizing may be achieved in formation 31 prior to or subsequent to the placing of aggregate pack 52.

After the placing of the aggregate pack, the desired treatment operations on formation 31, and the well killing operation, the dual conduit tubing string 38 may be removed from the well, taking with it collar 41, tube 44, sealing disc 45, tube 50, and checkvalve 51. It can be seen from the above description of the operation of this apparatus that subsequent formations above packer 33 may also be treated and packed in very similar operation to that of formation 31. All that is required for additional formation treatments is an additional packer, packer mandrel, ported screen, and seal tube extension for each formation.

Thus, it can be seen that with the apparatus of this invention any number of high pressure formations may be treated and packed with aggregate utilizing a minimum number of steps and operations while maintaining full precautions at all times against hazardous high-pressure gas blow-outs. The present invention eliminates the need for costly trips in and out of the hole to wash in the screen and also eliminates the need for using complex and undependable crossover tools to place the aggregate around the screen.

Although a specific preferred embodiment of the present invention has been described in the detailed description above, the description is not intended to limit the invention to the particular forms or embodiments disclosed herein, since they are to be recognized as illustrative rather than restrictive and it will be obvious to those skilled in the art that the invention is not so limited. For instance, whereas hydraulic actuated packers were described with respect to the preferred embodiment, it is clear that other type of packers could be utilized such as mechanically actuated or wireline actuated. Also, where a ball valve was pumped down the tubing to set and actuate the sleeve valve, it is clear that other type of actuation means could be used. For example, a plug could be pumped down the tubing to actuate the sleeve valve or the sleeve valve could be arranged for wireline actuation or for hydraulic actuation. Thus, this invention is declared to cover all changes and modifications of the specific example of the invention herein disclosed for purposes of illustration which do not constitute departures from the spirit and scope of the invention.

The embodiments of the invention in which an exclusive property or privilege is claimed are defined as follows:

1. Apparatus for treating an underground formation penetrated by a well bore, said apparatus comprising:
- an elongated ported tubular mandrel;
- a well packer mounted on said mandrel;
- a sandscreen mounted on said mandrel;
- a first conduit means adapted for passing through said packer and mandrel and into said sandscreen;
- valve means in said first conduit means arranged to communicate with port means in said mandrel;
- seal means below said valve means and said port means and adapted to seal between said first conduit means and said mandrel; and,
- a second conduit means beside said first conduit means communicating with said mandrel above said seal means.

2. The treating apparatus of claim 1 further comprising:
- a second well packer located above a second producing formation in the well bore;
- a second tubular mandrel passing through said second packer;
- one or more secondary sandscreens on said second mandrel below said second packer and arranged to communicate with the second producing formation; and,
- a seal tube extension attached to said secondary sandscreens and extending into said first packer in sealing relationship therein.

3. The treating apparatus of claim 2 further comprising checkvalve means at the lower end of said first conduit means and adapted to sealingly engage in said seal tube extension.

4. Apparatus for treating and gravel packing multiple intervals in a well bore, said apparatus comprising:
- a plurality of expandable well packers each having passage means therethrough and adapted to sealingly engage the borehole wall;
- a plurality of tubular mandrels each passing through one of said well packers and each having port means through the wall thereof;
- a plurality of sandscreens adapted to prevent the migration of aggregates therethrough, with at least one sandscreen attached to each of sand mandrels;
- first conduit means adapted to be lowered through the uppermost of said well packers and sealingly engaged in the uppermost of said mandrels in bypassing relationship around said mandrel port means;
- second conduit means arranged to pass sealingly through said uppermost well packer and communicate with said uppermost mandrel port means;

valve means in said first conduit means arranged to preselectively communicate with said uppermost port means; and, a seal tube extension connected to said sandscreen below said uppermost well packer, and arranged to sealingly engage in said well packer below said uppermost well packer.

5. The treating apparatus of claim 4 further comprising checkvalve means on said first conduit lower end arranged to sealingly engage in the well packer immediately below said uppermost well packer.

6. A method of placing multiple aggregate packs in an oil well bore having multiple high-pressure producing intervals, said method comprising:

lowering into the well bore a well packer having a sandscreen and port means therebelow;

positioning the sandscreen adjacent the lowermost formation;

actuating said well packer into sealing engagement above the lowermost formation;

lowering into said well packer a dual string assembly having a bore seal means below said well packer port means, one long and one short tubing string, with said long tubing string extending through said seal means, and valve means in said long tubing string above said seal means and adapted to preselectively communicate with said well packer port means;

pumping a suspension of carrier fluid and aggregate through the shorter conduit string and out said well packer port means into the well bore annulus;

flowing said carrier fluid through said sandscreen and up said long conduit string;

opening said valve means;

pumping a well killing fluid through said short string, through said valve means, and up said long string thereby killing the well;

removing said dual string assembly from the well bore; and, repeating said steps for each said producing interval in the well bore.

7. A method of placing an aggregate pack in a high-pressure formation in a well bore, comprising:

setting in the producing interval of the well bore a packer having a ported mandrel and sandscreen therebelow;

flowing through a first conduit a suspension of aggregate in a carrier fluid down the well bore and out the ported mandrel into the annulus below the packer;

returning the carrier fluid through the sandscreen and up a second flow conduit in the well bore;

diverting the flow path from the first conduit through said packer and directly into the second conduit; and, flowing a well killing fluid through said first conduit and up said second conduit.

8. The method of claim 7 further comprising flowing a treating fluid through said first conduit and into the producing formation prior to said diverting step.

9. A method of placing multiple aggregate packs in a high pressure well bore having multiple producing intervals, said method comprising the steps of:

setting in the lowermost producing interval a packer having a ported tubular mandrel passing therethrough with sandscreen means attached therebelow;

flowing through a first conduit a suspension of aggregate and carrier fluid down the well bore and out the ported mandrel into the annulus below the packer;

returning the carrier fluid through the sandscreen and up a second conduit through the well bore;

diverting the flow path of the first conduit into the second conduit above the sandscreen;

flowing a well killing fluid into the first conduit and up the second conduit thereby killing the well; and, repeating said steps for each high pressure producing interval in the well.

10. A treating tool for placing aggregate packs and treating fluids into the producing areas of an oil well borehole wherein said areas are isolated by well packers having ported mandrels and sandscreens therebelow; said treating tool comprising:

a first conduit string adapted to extend down the well bore and through a well packer;

upper seal means on said first conduit adapted to seal in a well packer above a ported mandrel;

lower seal means on said first conduit adapted to seal in a ported mandrel between the mandrel ports and a sandscreen;

valve means in the wall of said first conduit arranged in proximity to the mandrel ports; and, second conduit means extending down said well bore through said upper seal means and arranged to communicate with the mandrel ports and said valve means.

11. The treating tool of claim 10 further comprising checkvalve means at the lower end of said first conduit string arranged to prevent downward flow therethrough and arranged to seal in a well packer therebelow; and, said lower end of said first conduit string below said lower seal means having a plurality of perforations through the wall thereof.

* * * * *